US009506020B2

(12) United States Patent
Giles et al.

(10) Patent No.: US 9,506,020 B2
(45) Date of Patent: Nov. 29, 2016

(54) AUTOMATIC DISHWASHING COMPOSITION

(75) Inventors: Matthew Robert Giles, Hoole (GB); Nicholas John Dixon, Upton (GB)

(73) Assignee: Innospec Limited (GB)

( * ) Notice: Subject to any disclaimer, the term of this patent is extended or adjusted under 35 U.S.C. 154(b) by 645 days.

(21) Appl. No.: 13/876,337

(22) PCT Filed: Sep. 22, 2011

(86) PCT No.: PCT/GB2011/051796

§ 371 (c)(1),
(2), (4) Date: Apr. 24, 2013

(87) PCT Pub. No.: WO2012/038755

PCT Pub. Date: Mar. 29, 2012

(65) Prior Publication Data

US 2013/0206181 A1 Aug. 15, 2013

(30) Foreign Application Priority Data

Sep. 23, 2010 (GB) ..... 1016001.8

(51) Int. Cl.

| | |
|---|---|
| ***C11D 3/37*** | (2006.01) |
| ***C11D 7/26*** | (2006.01) |
| ***C11D 7/32*** | (2006.01) |
| ***A47L 15/42*** | (2006.01) |
| ***C11D 3/20*** | (2006.01) |
| ***C11D 3/33*** | (2006.01) |
| ***C11D 3/36*** | (2006.01) |

(52) U.S. Cl.

CPC ..... *C11D 3/3765* (2013.01); *A47L 15/42* (2013.01); *C11D 3/2086* (2013.01); *C11D 3/33* (2013.01); *C11D 3/361* (2013.01); *C11D 3/364* (2013.01); *C11D 3/3784* (2013.01); *C11D 7/265* (2013.01); *C11D 7/3245* (2013.01)

(58) Field of Classification Search

CPC ..... C11D 3/33; C11D 3/361
See application file for complete search history.

(56) References Cited

U.S. PATENT DOCUMENTS

| | | | | |
|---|---|---|---|---|
| 6,387,864 | B1 * | 5/2002 | Bartelme | 510/336 |
| 6,472,363 | B1 | 10/2002 | Arvanitidou et al. | |
| 7,135,448 | B2 * | 11/2006 | Lentsch et al. | 510/220 |
| 7,196,044 | B2 * | 3/2007 | Smith et al. | 510/225 |
| 8,748,364 | B2 * | 6/2014 | Silvernail | C11D 3/33 510/223 |
| 2005/0003979 | A1 * | 1/2005 | Lentsch et al. | 510/220 |
| 2006/0234900 | A1 * | 10/2006 | Olson et al. | 510/447 |
| 2011/0269660 | A1 * | 11/2011 | Miralles | 510/219 |
| 2012/0068113 | A1 * | 3/2012 | Giles et al. | 252/186.29 |

FOREIGN PATENT DOCUMENTS

| | | | |
|---|---|---|---|
| CA | 941705 | A1 | 2/1974 |
| DE | 3743739 | A1 | 7/1989 |
| EP | 0808894 | A1 | 11/1997 |
| EP | 2045317 | A1 | 4/2009 |
| GB | 2293829 | A | 4/1996 |
| JP | 108095 | A | 1/1998 |
| JP | 2004168993 | A | 6/2004 |
| JP | 2008127490 | | 6/2008 |
| WO | 2007141635 | A2 | 12/2007 |
| WO | 2010084351 | A1 | 7/2010 |

OTHER PUBLICATIONS

International Search Report dated Dec. 16, 2011 for PCT/GB2011/051796.
Database WPI Week 200860, Thomson Scientific, XP002665306 dated Jun. 5, 2008.
International Preliminary Report on Patentability dated Apr. 4, 2013 for PCT/GB2011/051796.

* cited by examiner

*Primary Examiner* — Gregory Webb
(74) *Attorney, Agent, or Firm* — Janine M. Susan; Burns & Levinson LLP

(57) ABSTRACT

An automatic dishwashing composition offering good performance especially in the removal of stubborn stains, such as tea stains, comprises a chelating agent selected from hydroxyethyliminodiacetic acid, glucoheptonic acid, hydroxyethylethylenediaminetriacetic acid, poly(acrylic acid-co-hypophosphite), and salts, complexes and mixtures thereof; wherein the composition is substantially free of phosphate containing builders and substantially free of bleaching compounds.

8 Claims, No Drawings

AUTOMATIC DISHWASHING COMPOSITION

CROSS-REFERENCE TO RELATED APPLICATIONS

This application is a U.S. national stage application under 35 U.S.C. 371 of co-pending International Application No. PCT/GB11/51796 filed Sep. 22, 2011 and entitled AUTOMATIC DISHWASHING COMPOSITION, which in turn claims priority to Great Britain Patent Application No. 1016001.8 filed Sep. 23, 2010, both of which are incorporated by reference herein in their entirety for all purposes.

The present invention relates to automatic dishwashing compositions and methods and uses relating thereto. In particular the invention relates to dishwashing compositions having an improved environmental profile.

Automatic dishwashing detergents typically comprise high level of builders and silicates and/or carbonates and lower levels of surfactants and bleaches. Further components such as other pH control agents, enzymes, thickeners, defoamers, colours, fragrances and the like may also be present. Liquid and gel compositions also include water and optionally other solvents.

Builders are an essential ingredient to provide sequestration, soil suspension, alkalinity and emulsification properties to the composition. For many years the builder of choice was sodium tripolyphosphate. However in recent years the use of phosphates has not been favoured for environmental reasons. It is known to replace phosphate with alternative builders. However this can lead to compositions having reduced cleaning performance. Some stains, in particular tea stains, are known to be difficult to remove in compositions which are phosphate free.

Furthermore there is also a desire to reduce overall phosphorus content in an automatic dishwashing composition and to provide formulations with improved biodegradability.

One method used to assist the removal of stains such as tea stains is to include a bleach in the composition. Typical bleaches used in automatic dishwashing include hypochlorite based bleaches and peroxygen bleaches. However the inclusion of bleaches in automatic dishwashing composition can sometimes be difficult due to stability issues and lack of compatibility with other components.

Automatic dishwashing composition of the prior art which do not include phosphate builders or a bleach suffer the disadvantage that they are poor at removing certain stains from dishware. In particular, these compositions show poor performance in the removal of tea stains.

The inventors have surprisingly found that the addition of a specified chelant gives an improvement in the performance of a dishwashing composition especially in the removal of stubborn stains, such as tea stains.

The inventors have also found that automatic dishwashing compositions can be prepared with reduced phosphorus content and improved biodegradability.

According to a first aspect of the present invention there is provided an automatic dishwashing composition comprising a chelating agent selected from hydroxyethyliminodiacetic acid, glucoheptonic acid, hydroxyethylethylenediaminetriacetic acid, poly(acrylic acid-co-hypophosphite), and salts, complexes and mixtures thereof; wherein the composition is substantially free of phosphate containing builders and substantially free of bleaching compounds.

The phosphate containing builders typically used in automatic dishwashing compositions are oligophosphate ions, most commonly the tripolyphosphate pentaanion, the pyrophosphate tetraanion, and the cyclic trimetaphosphate trianion. These builders are generally available as sodium, potassium, or mixed metal salts.

The automatic dishwashing compositions of the present invention are substantially free of such phosphate containing builders. By substantially free of we mean than builders of this type are present in the compositions of the present invention in an amount of less than 1 wt %, preferably less than 0.5 wt %, more preferably less than 0.25 wt %, preferably less than 0.1 wt %, suitably less than 0.05 wt %, more preferably less than 0.01 wt %, preferably less than 0.005 wt % and most preferably less than 0.001 wt %.

As mentioned above typical bleaching components used in automatic dishwashing compositions include hypochlorite or "chlorine bleaches" which contain or deliver hypochlorite ($OCl^-$) in solution, and peroxygen bleaches, typically perborate or percarbonate salts, which produce peroxide in aqueous solutions. The automatic dishwashing composition of the present invention is substantially free of such bleaching compounds. By this we mean that the compositions preferably comprise less than 1 wt % of such bleaching compounds, preferably less than 0.5 wt %, more preferably less than 0.25 wt %, preferably less than 0.1 wt %, suitably less than 0.05 wt %, more preferably less than 0.01 wt %, preferably less than 0.005 wt % and most preferably less than 0.001 wt %.

The chelating agent is preferably present in an amount of at least 0.5 wt %, preferably at least 1 wt %, more preferably at least 1.5 wt %, suitably at least 2 wt %, preferably at least 2.5 wt %, more preferably at least 3 wt %, suitably at least 3.5 wt % and more preferably at least 4 wt %.

The chelating agent may be present in an amount of up to 45 wt %, suitably up to 40 wt %, preferably up to 37 wt %, more preferably up to 35 wt % and most preferably up to 32 wt %. In some embodiments it may be present in an amount of up to 25 wt %, suitably up to 20 wt %, for example up to 17 wt % or up to 15 wt %.

In embodiments in which the chelating agent comprises a mixture of two or more of the listed chelating agents the above amounts refer to the total amount of all such chelating agents present in the composition.

Where the chelating agent(s) is/are present as a salt or complex the above amounts refer to the amount of free acid that would be present if an equivalent molar quantity of the anion were present i.e. in calculating the amount of chelating agent used as a salt, or complex the mass of any cation or complexing agent is ignored and replaced by an equivalent number of hydrogen ions.

Unless otherwise stated all amounts used in this specification refer to the amount of active ingredient included in a composition. The skilled person will appreciate that chelating agents are often available commercially as concentrated solutions.

In some embodiments the composition comprises hydroxyethyliminodiacetic acid or a salt or complex thereof.

Hydroxyethyliminodiacetic acid (HEIDA) has the structure shown in formula I:

Formula I

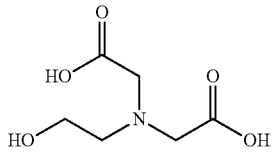

In the compositions of the present invention HEIDA may be present having the structure shown in formula I and/or the same structure in which a number of the acidic protons have been replaced, i.e. in which 1 or 2 of the acid groups have been neutralised or partially neutralised. It may be present as a free acid or a salt or complex thereof.

HEIDA is commercially available from Dow Chemicals as the disodium salt.

In some embodiments the composition comprises hydroxyethylethylenediaminetriacetic acid or a salt or complex thereof.

Hydroxyethylethylenediaminetriacetic acid (known as HEEDTA or HEDTA) has the structure shown in formula II:

Formula II

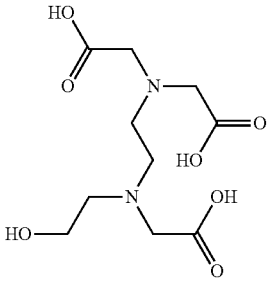

In the compositions of the present invention HEDTA may be present having the structure shown in formula II and/or the same structure in which a number of the acidic protons have been replaced, i.e. in which 1, 2 or 3 of the acid groups have been neutralised or partially neutralised. It may be present as a free acid or a salt or complex thereof.

HEDTA is commercially available from Akzo Nobel as the trisodium salt under the trade mark Dissolvine H40.

In some embodiments the composition comprises glucoheptonic acid or a salt or complex thereof.

Glucoheptonic acid may in some cases be used to describe a number of isomers. However the glucoheptonic acid used in the automatic dishwashing compositions of the present invention suitably has the structure β-glucoheptonic acid shown in formula III:

Formula III

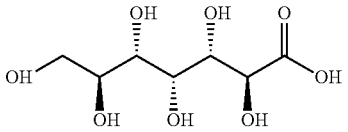

This compound may exist in a number of stereoisomeric forms and any of the enantiomers and diastereomers thereof maybe used in the present invention. Two common commercially available forms are α-glucoheptonic acid and β-glucoheptonic acid. In the automatic dishwashing compositions of the present invention glucoheptonic acid is preferably present as β-glucoheptonic acid, that is the compound having the structure shown in formula III. It may alternatively be present as a salt in which the acid group has been neutralised or a complex in which the acid group is complexed with another species.

The sodium salt of glucoheptonic acid is commercially available from Croda as a as a sodium salt or a boron complex and is sold under the trade mark Crodaquest.

In some embodiments the composition comprises poly (acrylic acid-co-hypophosphite) or a salt or complex thereof.

Poly(acrylic-acid co-hypophosphite) has the general structure shown in formula IV:

Formula IV

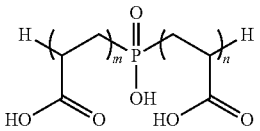

Typically, the molecular weight of the poly(acrylic acid co-hypophosphite) is less than 10,000, preferably less than 5,000, preferably less than 3,000. Preferably m is at least 1 and n may be 0 but is preferably at least 1. Preferably the sum of [m+n] is up to 135 and most preferably up to 40.

Poly(acrylic-acid co-hypophosphite) may be present in the form shown, or as the sodium or potassium salt or as a complex.

Suitable polymers are available under the brand name Belsperse from BWA water additives.

In the automatic dishwashing compositions of the present invention poly(acrylic acid-co-hypophosphite) may be present in the form shown in formula IV or it may be present as a salt or complex.

Poly(acrylic acid-co-hypophosphite) is commercially available from BWA Water Additives and is sold under the trade mark Belsperse.

In some preferred embodiments the automatic dishwashing composition of the present invention comprises hydroxyethyliminodiacetic acid or a salt or complex thereof.

In some preferred embodiments the automatic dishwashing composition of the present invention comprises glucoheptonic acid or a salt or complex thereof.

In some preferred embodiments the automatic dishwashing composition of the present invention comprises hydroxyethylethylenediaminetriacetic acid or a salt or complex thereof.

In some preferred embodiments the automatic dishwashing composition of the present invention comprises poly (acrylic acid-co-hypophosphite) or a salt or complex thereof.

The chelating agent may be present as a complex, for example a boron complex.

In some preferred embodiments the automatic dishwashing composition of the present invention further comprises one or more further chelating agents. The further chelating agents are preferably selected from 1-hydroxyethylidene-1, 1-diphosphonic acid (HEDP), ethylenediamine disuccinic acid (EDDS), methylglycinediacetic acid (MGDA), glutamic acid, N,N-diacetic acid (GLDA), iminodisuccinic acid (IDS); ethylenediaminetetraacetic acid (EDTA), diethylenetriaminepentaacetic acid (DTPA), diethylenetriaminepentamethylene phosphonic acid (DTPMPA), nitrilotriacetic acid (NTA), aspartic acid diethoxysuccinic acid (AES), aspartic acid-N,N-diacetic acid (ASDA), ethylenediamine tetra methylene phosphonic acid (EDTMP), iminodifumaric (IDF), iminoditartaric acid (IDT), iminodimaleic acid (IDMAL), iminodimalic acid (IDM), ethylenediaminedifumaric acid (EDDF), ethylenediaminedimalic acid (EDDM), ethylenediamineditartaric acid (EDDT), ethylenediaminedimaleic acid and (EDDMAL), aminotri(methylenephosphonic acid) (ATMP); and salts and mixtures thereof.

Where any chelating agent described herein is present as a salt it may be present as a metal salt, for example an alkali metal salt, or it may be present as an ammonium or quaternary ammonium salt. Suitable metal salts include salts or potassium, sodium, boron, magnesium, zinc or a mixture thereof. Especially preferred are sodium salts. Suitable ammonium salts include salts of ammonia and ethanolamine.

In some preferred embodiments the composition of the present invention comprises less than 20 wt % phosphonate chelating agents, preferably less than 15 wt %, preferably less than 12 wt %, more preferably less than 10 wt %, suitably less than 8 wt %, for example less than 7 wt % or less than 6 wt %.

By phosphonate chelating agents we mean to include compounds derived from substituted phosphonic acids. Such compounds are known to the person skilled in the art and include, for example 1-hydroxyethylidene-1,1-diphosphonic acid (HEDP), diethylenetriaminepentamethylene-phosphonic acid (DTPMPA), aminotri(methylenephosphonic acid) (ATMP) and ethylenediamine tetra methylene phosphonic acid (EDTMP).

In some preferred embodiments the automatic dishwashing composition of the present invention comprises:

i) a chelating agent selected from hydroxyethyliminodiacetic acid, glucoheptonic acid, hydroxyethylethylenediaminetriacetic acid, poly(acrylic acid-co-hypophosphite), and salts, complexes and mixtures thereof; and
ii) one or more chelating agents selected from the group consisting of phosphonate based chelating agents and biodegradable chelating agents (but not being a chelating agent of group i).

In such embodiments component (i) is suitably present in an amount of at least 0.5 wt %, preferably at least 1 wt %, more preferably at least 1.5 wt %, suitably at least 2 wt %, preferably at least 2.5 wt %, more preferably at least 3 wt %, suitably at least 3.5 wt % and more preferably at least 4 wt %.

Component (i) may be present in an amount of up to 45 wt %, suitably up to 40 wt %, preferably up to 37 wt %, more preferably up to 35 wt % and most preferably up to 32 wt %. In some embodiments it may be present in an amount of up to 25 wt %, suitably up to 20 wt %, for example up to 17 wt % or up to 15 wt %.

In such embodiments component (ii) is suitably present in an amount of at least 0.5 wt %, preferably at least 1 wt %, more preferably at least 1.5 wt %, suitably at least 2 wt %, preferably at least 2.5 wt %, more preferably at least 3 wt %, suitably at least 3.5 wt % and more preferably at least 4 wt %.

Component (ii) may be present in an amount of up to 45 wt %, suitably up to 40 wt %, preferably up to 37 wt %, more preferably up to 35 wt % and most preferably up to 32 wt %. In some embodiments it may be present in an amount of up to 25 wt %, suitably up to 20 wt %, for example up to 17 wt % or up to 15 wt %.

In automatic dishwashing compositions of this type the total amount of component (i) and component (ii) is preferably from 0.5 to 5.0 wt %, suitably from 2 to 30 wt %, preferably from 5 to 25 wt % and more preferably from 10 to 20 wt %.

Preferably the weight ratio of component (i) to component (ii) is from 1:99 to 99:1, suitably from 1:9 to 9:1, preferably from 1:5 to 5:1, more preferably from 1:3 to 3:1, preferably from 1:2 to 2:1. In an especially preferred embodiment the weight ratio of component (i) to component (ii) is about 1:1.

Each of components (i) and (ii) may include a mixture and where mixtures are present the amounts above refer to the total amounts of all such components present in the composition.

Preferred phosphonate based chelating agents for use herein include 1-hydroxyethylidene-1,1-diphosphonic acid (HEDP), diethylenetriaminepentamethylene-phosphonic acid (DTPMPA), aminotri(methylenephosphonic acid) (ATMP), ethylenediamine tetra methylene phosphonic acid (EDTMP) and salts and mixtures thereof.

1-hydroxyethylidene-1,1-diphosphonic acid (HEDP) has the structure shown in formula V:

Formula V

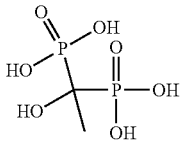

Commercially available HEDP is sold as a viscous yellow liquid comprising approximately 60 wt % active, and is highly acidic. It may be present in the automatic dishwashing compositions of the present invention as the free acid or a salt or complex thereof. Preferably it is added as the free acid.

Diethylenetriaminepentamethylene-phosphonic acid (DTPMPA) has the structure shown in formula VI:

Formula VI

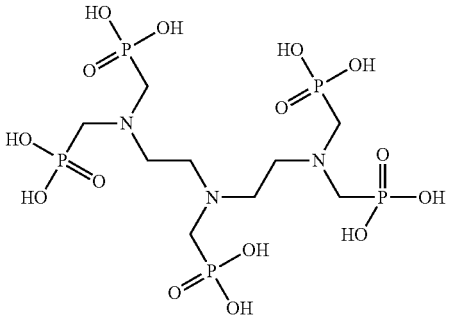

This compound may also be referred to as DETPMP or DTPMP. It may be present in the automatic dishwashing compositions of the present invention as the free acid or a salt or complex thereof. DTPMPA is commercially available as the heptasodium salt form Thermophos and is sold under the trade mark Dequest 2060 series.

Aminotri(methylenephosphonic acid) (ATMP) has the structure shown in formula VII:

Formula VII

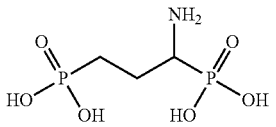

It may be present in the automatic dishwashing compositions of the present invention as the free acid or a salt or complex thereof. ATMP is commercially available as the free acid or the sodium salt. It is sold by Thermophos under the trade mark Dequest 2000 series.

Ethylenediamine tetra methylene phosphonic acid (EDTMP) has the structure shown in formula VIII:

Formula VIII

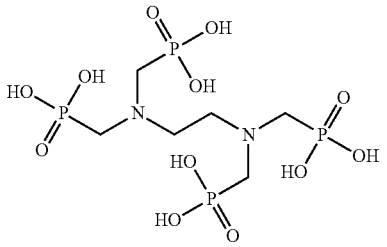

It may be present in the automatic dishwashing compositions of the present invention as the free acid or a salt or complex thereof. It is commercially available as the sodium salt from Thermophos under the trade mark Dequest 2040 series.

Preferred biodegradable chelating agents for use herein include ethylenediamine disuccinic acid (EDDS), methylglycinediacetic acid (MGDA), glutamic acid, N,N-diacetic acid (GLDA), iminodisuccinic acid (IDS), nitrilotriacetic acid (NTA) and salts and mixtures thereof.

Preferred biodegradable chelating agents for use herein include ethylenediamine disuccinic acid (EDDS), methylglycinediacetic acid (MGDA), glutamic acid, N,N-diacetic acid (GLDA), iminodisuccinic acid (IDS) and salts and mixtures thereof.

Ethylenediamine disuccinic acid (EDDS) which has the structure shown in formula IX:

Formula IX

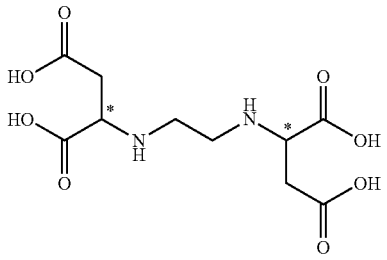

EDDS includes two stereogenic centres and there are three possible stereoisomers. A particularly preferred configuration is [S,S]-ethylenediamine disuccinic acid which is readily biodegradable.

In the compositions of the present invention "EDDS" may be present having the structure shown in formula VIII and/or the same structure in which a number of the hydrogen atoms have been replaced. Thus EDDS may also contain succinate salts in which 1, 2, 3 or 4 of the acid groups have been neutralised or partially neutralised. It may be present as a free acid or a salt or complex thereof.

One commercially available material is trisodium ethylenediamine disuccinate. Although this compound can be prepared as a solid, the solid form is very hygroscopic and rapidly absorbs water. The commercial product is therefore supplied as an aqueous solution comprising 30% by weight EDDS (expressed as free acid), or 37 wt % of the trisodium salt (including the counterion).

Another commercially available form of EDDS is the tetra acid. This is provided as a powder which contains 65 wt % solid [S,S] EDDS as an acid and water of crystallisation.

Methylglycinediacetic acid (MGDA) has the structure shown in formula X:

Formula X

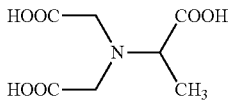

In the compositions of the present invention MGDA may be present having the structure shown in formula X and/or the same structure in which a number of the acidic protons have been replaced i.e. in which 1, 2 or 3 the acid groups have been neutralised or partially neutralised. It may be present as a free acid or a salt or complex thereof.

MGDA may be present as either enantiomer or a mixture thereof. Preferably it is present as a racemic mixture.

MGDA is commercially available as a solution comprising 40 wt % of the trisodium salt and is sold under the trade mark Trilon M.

Glutamic acid N,N-diacetic acid (GLDA) has the structure shown in formula XI:

Formula XI

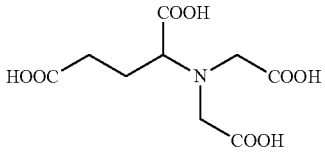

In the compositions of the present invention GLDA, may be present having the structure shown in formula XI and/or the same structure in which a number of the acidic protons have been replaced, i.e. in which 1, 2, 3 or 4 of the acid groups have been neutralised or partially neutralised. It may be present as a free acid or a salt or complex thereof.

GLDA may be present as either enantiomer or a mixture thereof. Preferably at least 50% is present as [S]-GLDA, preferably at least 70%, more preferably at least 90%, most preferably at least 95 wt %, for example about 98 wt %. In some preferred embodiments the GLDA consists essentially of the S enantiomer.

GLDA is commercially available as a solution comprising 38 wt % of the tetrasodium salt and is sold under the trade mark Dissolvine GL-38.

Iminodisuccinic acid (IDS) has the structure shown in formula XII:

Formula XII

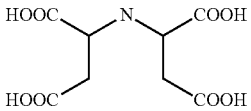

In the compositions of the present invention IDS may be present having the structure shown in formula XII and/or the same structure in which a number of the acidic protons have been replaced, i.e. in which 1, 2, 3 or 4 of the acid groups have been neutralised or partially neutralised. It may be present as a free acid or a salt or complex thereof.

IDS or a salt thereof may be present as either enantiomer or a mixture thereof. Preferably it is present as a racemic mixture.

IDS is commercially available as a solution comprising 34 wt % of the tetrasodium salt and is sold under the trade mark Baypure CX100.

Component (ii) may be selected from 1-hydroxyethylidene-1,1-diphosphonic acid (HEDP), diethylenetriamine-pentamethylene-phosphonic acid (DTPMPA), aminotri (methylene-phosphonic acid) (ATMP), ethylenediamine tetra methylene phosphonic acid (EDTMP), ethylenediamine disuccinic acid (EDDS), methylglycinediacetic acid (MGDA), glutamic acid, N,N-diacetic acid (GLDA), iminodisuccinic acid (IDS), nitrilotriacetic acid (NTA) and salts and mixtures thereof.

In some embodiments component (ii) is selected from ethylenediamine disuccinic acid (EDDS), 1-hydroxyethylidene-1,1-diphosphonic acid (HEDP) and salts and mixtures thereof.

In some preferred embodiments component (ii) comprises a phosphonate based chelating agent.

In some preferred embodiments component (ii) comprises a biodegradable chelating agent.

Component (ii) may be selected from 1-hydroxyethylidene-1,1-diphosphonic acid (HEDP), diethylenetriamine-pentamethylene-phosphonic acid (DTPMPA), aminotri (methylene-phosphonic acid) (ATMP), ethylenediamine tetra methylene phosphonic acid (EDTMP) and salts and mixtures thereof.

In some preferred embodiments component (ii) comprises 1-hydroxyethylidene-1,1-diphosphonic acid (HEDP).

Component (ii) may be selected from ethylenediamine disuccinic acid (EDDS), methylglycinediacetic acid (MGDA), glutamic acid, N,N-diacetic acid (GLDA), iminodisuccinic acid (IDS), nitrilotriacetic acid (NTA) and salts and mixtures thereof.

In some preferred embodiments component (ii) comprises ethylenediamine disuccinic acid (EDDS).

In some embodiments the composition comprising components (i) and (ii) comprises less than 20 wt % phosphonate chelating agents, preferably less than 15 wt %, preferably less than 12 wt %, more preferably less than 10 wt %, suitably less than 8 wt %, for example less than 7 wt % or less than 6 wt %.

In some preferred embodiments the automatic dishwashing composition of the present invention comprises:

a) a chelating agent selected from hydroxyethyliminodiacetic acid, glucoheptonic acid, hydroxyethylethylenediaminetriacetic acid, poly(acrylic acid-co-hypophosphite), and salts, complexes and mixtures thereof;
b) one or more phosphonate based chelating agents; and
c) one or more additional chelating agents, which are not phosphonate based and which are biodegradable In such embodiments component (a) is suitably present in an amount of at least 0.5 wt %, preferably at least 1 wt %, more preferably at least 1.5 wt %, suitably at least 2 wt %, preferably at least 2.5 wt %, more preferably at least 3 wt %, suitably at least 3.5 wt % and more preferably at least 4 wt %.

Component (a) may be present in an amount of up to 45 wt %, suitably up to 40 wt %, preferably up to 37 wt %, more preferably up to 35 wt % and most preferably up to 32 wt %. In some embodiments it may be present in an amount of up to 25 wt %, suitably up to 20 wt %, for example up to 17 wt % or up to 15 wt %.

In such embodiments component (b) is suitably present in an amount of at least 0.5 wt %, preferably at least 1 wt %, more preferably at least 1.5 wt %, suitably at least 2 wt %, preferably at least 2.5 wt %, more preferably at least 3 wt %, suitably at least 3.5 wt % and more preferably at least 4 wt %.

Component (b) may be present in an amount of up to 45 wt %, suitably up to 40 wt %, preferably up to 37 wt %, more preferably up to 35 wt % and most preferably up to 32 wt %. In some embodiments it may be present in an amount of up to 25 wt %, suitably up to 20 wt %, for example up to 17 wt % or up to 15 wt %.

In some embodiments component (b) is present in an amount of less than 14 wt %, preferably less than 12 wt %, suitably less than 10 wt %, preferably less than 8 wt %, for example less than 7 wt % or less than 6 wt %.

In such embodiments component (c) is suitably present in an amount of at least 0.5 wt %, preferably at least 1 wt %, more preferably at least 1.5 wt %, suitably at least 2 wt %, preferably at least 2.5 wt %, more preferably at least 3 wt %, suitably at least 3.5 wt % and more preferably at least 4 wt %.

Component (c) may be present in an amount of up to 45 wt %, suitably up to 40 wt %, preferably up to 37 wt %, more preferably up to 35 wt % and most preferably up to 32 wt %. In some embodiments it may be present in an amount of up to 25 wt %, suitably up to 20 wt %, for example up to 17 wt % or up to 15 wt %.

In automatic dishwashing compositions of this type the total amount of components (a), (b) and (c) is preferably from 0.5 to 50 wt %, suitably from 2 to 30 wt %, preferably from 5 to 25 wt % and more preferably from 10 to 20 wt %.

Preferably the weight ratio of components (b) to component (c) is from 1:99 to 99:1, suitably from 1:9 to 9:1, preferably from 1:5 to 5:1, more preferably from 1:3 to 3:1, for example from 1:2 to 2:1. In some preferred embodiments the weight ratio of component (b) to component (c) is about 1:1.

The weight ratio of component (a) to the total of components (b) and (c) i.e., (a):(b+c) is preferably from 1:99 to 49:1, suitably from 1:9 to 5:1, preferably from 1:5 to 3:1, suitably from 1:4 to 2:1, for example from 1:2 to 1:1.

Each of components (a), (b) and (c) may include a mixture and where mixtures are present the amounts above refer to the total amounts of all such components present in the composition.

Preferred phosphonate based chelating agents and biodegradable chelating agents are as defined above.

Component (b) may be selected from 1-hydroxyethylidene-1,1-diphosphonic acid (HEDP), diethylenetriamine-pentamethylene-phosphonic acid (DTPMPA), ethylenediamine tetra methylene phosphonic acid (EDTMP), aminotri (methylenephosphonic acid) (ATMP), and salts, complexes and mixtures thereof.

In some preferred embodiments component (b) comprises 1-hydroxyethylidene-1,1-diphosphonic acid (HEDP).

Component (c) may be selected from ethylenediamine disuccinic acid (EDDS), methylglycinediacetic acid (MGDA), glutamic acid, N,N-diacetic acid (GLDA), iminodisuccinic acid (IDS), nitrilotriacetic acid (NTA) and salts, complexes and mixtures thereof.

In some preferred embodiments component (c) comprises ethylenediamine disuccinic acid (EDDS).

Thus in some especially preferred embodiments the automatic dishwashing composition of the present invention comprises 1-hydroxyethylidene-1,1-diphosphonic acid (HEDP), ethylenediamine disuccinic acid (EDDS) and a chelating agent selected from hydroxyethyliminodiacetic acid, glucoheptonic acid, hydroxyethylethylenediaminetriacetic acid, poly(acrylic acid-co-hypophosphite), and salts, complexes and mixtures thereof.

In some preferred embodiments phosphonate chelants comprise not greater than 75 wt % of the total weight of chelants in the composition, preferably not greater than 67 wt %, preferably not greater than 60 wt %, and most preferably not greater than 50 wt %.

The automatic dishwashing composition of the present invention may be provided in any suitable form. It may be in the form of a solid, for example a powder or granules, a liquid or a gel. It may be provided in unit dose form, for example as a pressed tablet or gel or liquid containing sachet. Such formulations are well known to the person skilled in the art. The composition of the present invention may be used as part of a final formulated product. For example it may be one or more phases of a multiphase product.

In preferred embodiments the automatic dishwashing composition of the present invention is a liquid or gel composition, preferably a liquid composition. Preferably it is an aqueous composition.

Preferably the composition has a pH of at least 7, more preferably at least 9, suitably at least 10, more preferably at least 11. It may have a pH of up to 14, suitably up to 13.

The automatic dishwashing compositions of the present invention suitably comprise further components that are commonly found in such compositions and are known to the person skilled in the art.

Preferably the composition further comprises a silicate. This is preferably present in an amount of from 5 to 25 wt %.

Preferred are sodium silicates and suitable compounds are known to the person skilled in the art. In addition to their sequestering properties, silicates provide alkalinity, soil suspension and anticorrosion properties.

Silicates used in automatic dishwashing compositions vary according to the $SiO_2/Na_2O$ ratio present. They are prepared by the reaction of sand and sodium carbonate at elevated temperatures. Commercially, ratios of 0.5-4 are available, depending on the ratios of starting materials used. Below a mole ratio of $SiO_2/Na_2O$ of 2, monomeric or dimeric silicate tetrahedra exist are formed. Mole ratios greater than 2 result in higher molecular weight silicates because of polymerization. The equilibrium between monomeric and polymeric silicate is affected by the pH of the solution. As the solution becomes more alkaline, the amount of monomeric species increases. For automatic dishwashing compositions disilicates with an $SiO_2/Na_2O$ ratio of 1:2-3 are generally used.

Preferably the composition further comprises a carbonate or bicarbonate, preferably a sodium, potassium or ammonium carbonate or bicarbonate; and most preferably sodium carbonate. A carbonate or bicarbonate is preferably present in an amount of from 5 to 15 wt %.

Sodium carbonate has been used in detergent formulations for many years both to sequester calcium ions in the wash water and as an alkalinity source.

The compositions of the present invention may further comprise a pH modifier. Any suitable acid or base may be used as appropriate. In some preferred embodiments sodium hydroxide, potassium hydroxide or ammonium hydroxide is used.

The compositions may further comprise one or more additional non-phosphate builders for example zeolites, citrates or polymeric builders. Polymers of carboxylic acids are commonly used. The choice of suitable additional builders will be well known to the person skilled in the art.

The composition may further comprise one or more further components for example enzymes (such as proteinases, amylases, and lipases), thickeners, colourants, fragrances and preservatives. Again the choice of such components is within the competence of the person skilled in the art.

The compositions of the present invention have been found to be particularly effective in the removal of stubborn stains from dishware. In particular the compositions have been effective in the removal of stubborn stains, for example tannin-containing stains, such as tea stains.

According to a second aspect of the present invention there is provided the use of a composition of the first aspect to remove stubborn stains from dishware. Preferably the stubborn stains are tannin-containing stains, such as tea stains.

According to a third aspect of the present invention there is provided the use of a chelating agent selected from hydroxyethyliminodiacetic acid, glucoheptonic acid, hydroxyethylethylenediaminetriacetic acid, poly(acrylic acid-co-hypophosphite), and salts and mixtures thereof to improve the stain-removing performance of an automatic dishwashing composition wherein the composition is substantially free of phosphate containing builders and substantially free of bleaching compounds.

Preferably the use of the third aspect improves the performance of the composition at removing stubborn stains, for example tannin-containing stains, such as tea stains. This can be measured by the test described herein in example 4.

According to a fourth aspect of the present invention there is provided a method of washing dishware in an automatic dishwasher, the method comprising adding to the dishwasher a unit dose of the composition of the first aspect and running a cycle of the dishwasher.

A unit dose is preferably from 5 g to 60 g, suitably from 10 g to 45 g. The dishwasher should be operated according to the manufacturer's instructions.

The invention will now be further described by the following non-limited examples. In the examples the amounts of each chelating agent refer to the amount that would be present as equivalent free acid but in some cases a sodium salt is used as a commercial source. The commercial source may also contain solvents and/or impurities but the amounts below refer to the level of active ingredient present.

EXAMPLES

Liquid dishwashing compositions were prepared comprising 9 wt % sodium carbonate, 15 wt % sodium silicate, and the further components listed in table 1 by dissolution in deionised water.

The pH of the solution was adjusted to 12.4-12.6 using sodium hydroxide and the balance to 100 wt % was provided with deionised water.

The compositions were then tested according to the following procedure:

Procedure

The effectiveness of the dishwasher formulation was measured using black tea soiling based on DIN 44990. Briefly, boil 2 liters of demineralised water and pour 1400 ml into a beaker. Add 10 ml each of: −6.72% solution of NaHCO3, 3.8% MgSO4.7H2O, 6.56% CaCl2.H2O and 0.05% Fe2(SO4)3 and fill the beaker up to 2000 ml. Add 24 g of Assam full pecco tea leaves and stir. Leave to stand for 5 minutes, then pour the tea through a sieve and throw away the tea left behind in the sieve. Pour 60 ml of tea liquor into each mug and put in an oven at 80° C. This was left overnight (17 hours) in the oven to evaporate fully and stain the cups.

Assessment of Performance

Seven cups were put into a small dishwasher (Zanussi Studio Line DCS5 12 W). The correct amount of liquid detergent was added and cups washed on a 55° C. cycle. At the end of the cycle the cups were taken out and visually inspected. The cups were assessed using the IKW "Methods for Ascertaining the performance of Dishwash detergents" (appendix 6), SOFW, vol. 122, 2006, p. 45 and an average score calculated for each composition, on a scale of 1 to 10 with 10 being the highest (i.e. cleanest cup).

The scores obtained for each example composition are also shown in table 1.

TABLE 1

| Example | HEDTA (wt %) | EDDS (wt %) | HEDP (wt %) | HEIDA | Poly(acrylic acid co-hypophosphite) (wt %) | Gluco-heptonic acid (wt %) | Sodium gluconate (wt %) | score |
|---|---|---|---|---|---|---|---|---|
| 1 | 15 | | | | | | | 6.4 |
| 2 | 5 | 5 | 5 | | | | | 7.6 |
| 3 | 7.5 | | 7.5 | | | | | 7.1 |
| 4 | 7.5 | 7.5 | | | | | | 6.7 |
| 5 (comp) | | 15 | | | | | | 5.9 |
| 6 | | 7.5 | | 7.5 | | | | 7 |
| 7 | | | | 15 | | | | 6.4 |
| 8 | | | 7.5 | 7.5 | | | | 8 |
| 9 | | 5 | 5 | 5 | | | | 7.9 |
| 10 | | | | | 15 | | | 6.6 |
| 11 | | 7.5 | | | 7.5 | | | 6.9 |
| 12 | | | 7.5 | | 7.5 | | | 8.6 |
| 13 | | 5 | 5 | | 5 | | | 8.7 |
| 14 | | 7.5 | | | | 7.5 | | 6.6 |
| 15 | | 5 | 5 | | | 5 | | 6.7 |
| 16 (comp) | | | 5 | | | | | 4.6 |
| 17 (comp) | | | 7.5 | | | | | 5.4 |
| 18 (comp) | | | 7.5 | | | | 7.5 | 5.6 |

The amounts of each component given in table 1 is the mass of equivalent free acid that would be present if the mass of any counterion is ignored.

HEDTA was used as the free acid (100 wt %).

EDDS was used as an aqueous solution of the trisodium salt comprising 30 wt % acid.

HEDP was used as an aqueous solution comprising 60 wt % of the free acid.

HEIDA was used as an aqueous solution of the disodium salt comprising 24 wt % acid.

Poly(acrylic acid co-hypophosphite) was obtained commercially as Belsperse 164® as an aqueous solution comprising 40 wt % acid.

Glucoheptonic acid was obtained commercially as Crodaquest B105® as an aqueous solution comprising 33 wt % acid.

Sodium gluconate was provided as a solid comprising 90 wt % equivalent acid.

The invention claimed is:

1. A method of removing stubborn stains comprising tannins from dishware, the method comprising washing the dishware in an automatic dishwasher including the steps of:

adding to the dishwasher an automatic dishwashing composition comprising (i) a chelating agent selected from the group consisting of hydroxyethyliminodiacetic acid, glucoheptonic acid, hydroxyethylethylenediaminetriacetic acid, poly(acrylic acid-co-hypophosphite), and salts, complexes and mixtures thereof; and (ii) one or more further chelating agents selected from the group consisting of ethylenediamine disuccinic acid (EDDS), and salts, complexes and mixtures thereof; and running a cycle of the dishwasher.

2. The method according to claim 1 wherein said automatic dishwashing composition comprises from 2 to 30 wt % of the chelating agents.

3. The method according to claim 1 further comprising one or more phosphonate based chelating agents selected from the group consisting of 1-hydroxyethylidene-1,1-diphosphonic acid (HEDP) and salts, complexes and mixtures thereof.

4. An automatic dishwashing composition comprising:

a) a chelating agent selected from the group consisting of hydroxyethyliminodiacetic acid, glucoheptonic acid, hydroxyethylethylenediaminetriacetic acid, poly (acrylic acid-co-hypophosphite), and salts, complexes and mixtures thereof;

b) one or more phosphonate based chelating agents; and c) one or more additional chelating agents, which are not phosphonate based and which are biodegradable, selected from the group consisting of ethylene diamine disuccinic acid (EDDS) and salts, complexes and mixtures thereof.

5. The automatic dishwashing composition according to claim 4 wherein component (b) is selected from the group consisting of 1-hydroxyethylidene-1,1-diphosphonic acid (HEDP) and salts, complexes and mixtures thereof.

6. The automatic dishwashing composition according to claim 4 comprising from 2 to 30 wt % of the chelating agents.

7. The automatic dishwashing composition according to claim 5 comprising from 2 to 30 wt % of the chelating agents.

8. The method according to claim 3 wherein said automatic dishwashing composition comprises from 2 to 30 wt % of the chelating agents.

* * * * *